US011517110B2

(12) United States Patent
Lu et al.

(10) Patent No.: US 11,517,110 B2
(45) Date of Patent: Dec. 6, 2022

(54) WOVEN STRUCTURE AND CHAIR WITH THE SAME

(71) Applicant: ZHEJIANG ZHENDONG LEISURE PRODUCTS CO., LTD., Linhai (CN)

(72) Inventors: Xiudong Lu, Linhai (CN); Qiaojin Lu, Linhai (CN)

(73) Assignee: ZHEJIANG ZHENDONG LEISURE PRODUCTS CO., LTD., Zhejiang (CN)

( * ) Notice: Subject to any disclaimer, the term of this patent is extended or adjusted under 35 U.S.C. 154(b) by 0 days.

(21) Appl. No.: 17/243,454

(22) Filed: Apr. 28, 2021

(65) Prior Publication Data

US 2021/0330083 A1 Oct. 28, 2021

(30) Foreign Application Priority Data

Apr. 28, 2020 (DE) ..... 10 2020 111 553.9

(51) Int. Cl.

| | |
|---|---|
| ***A47C 5/02*** | (2006.01) |
| ***A47C 4/28*** | (2006.01) |
| ***A47C 7/28*** | (2006.01) |
| ***D03D 3/00*** | (2006.01) |
| ***A47C 7/32*** | (2006.01) |
| ***A47C 31/11*** | (2006.01) |
| ***A47C 7/22*** | (2006.01) |

(52) U.S. Cl.

CPC ..... *A47C 5/02* (2013.01); *A47C 4/28* (2013.01); *A47C 7/22* (2013.01); *A47C 7/282* (2013.01); *A47C 7/32* (2013.01); *A47C 31/11* (2013.01); *D03D 3/00* (2013.01)

(58) Field of Classification Search

CPC .. A47C 5/02; A47C 4/28; A47C 7/282; A47C 7/22; A47C 7/32; A47C 31/11; A47C 4/48; A47C 5/10; A47C 4/30; A47C 4/44; A47C 1/0342; D03D 3/00

USPC .... 297/218.4, 451.9, 452.56, 452.63, 452.64

See application file for complete search history.

(56) References Cited

U.S. PATENT DOCUMENTS 2,444,873 A * 7/1948 Goldberg ..... A47C 31/04 160/DIG. 15
2,839,126 A * 6/1958 O'Neill ..... A47C 7/22 160/DIG. 15
2,871,926 A * 2/1959 Haschke ..... A47C 7/22 160/369

(Continued)

FOREIGN PATENT DOCUMENTS

EP 3033974 A1 * 6/2016 ..... A47C 3/00
EP 3443865 A1 * 2/2019 ..... A47C 5/00
WO WO-2017177774 A1 * 10/2017 ..... A47C 5/00

*Primary Examiner* — Robert Canfield

(74) *Attorney, Agent, or Firm* — Muncy, Geissler, Olds & Lowe, P.C.

(57) ABSTRACT

A woven structure, which includes a woven surface, a skeleton or a wrapping strip, and a chair with the same. The woven surface has an edge and is formed by a staggered arrangement of a plurality of woven strips. One or both ends of several or all the woven strips are provided with a first protrusion, and both ends of each woven strip form edges. The skeleton or the wrapping strip can be disposed and clamped with the first protrusion on the edges of the woven surface. The chair with the woven structure comprises a chair seat and a chair surface. The chair surface includes a woven structure and is fixed on the chair seat.

11 Claims, 4 Drawing Sheets

(56) References Cited

U.S. PATENT DOCUMENTS

| | | | | | |
|---|---|---|---|---|---|
| 2,878,861 | A * | 3/1959 | Molla | A47C 7/22 | 160/DIG. 15 |
| 3,094,358 | A * | 6/1963 | Hartman | A47C 7/22 | 297/452.64 |
| 5,762,403 | A * | 6/1998 | Robinson | A47C 7/40 | 297/440.11 |
| 5,836,655 | A * | 11/1998 | Laufer | A47C 31/04 | 297/452.56 |
| 9,560,916 | B1 * | 2/2017 | Bullard | A47C 7/28 | |
| 2005/0200189 | A1 * | 9/2005 | Schultz | A47C 31/023 | 297/452.64 |
| 2013/0062924 | A1 * | 3/2013 | Caldwell | A47C 7/16 | 297/452.63 |
| 2014/0110976 | A1 * | 4/2014 | Tang | A47C 5/10 | 297/173 |
| 2016/0174718 | A1 * | 6/2016 | Orlandoni | A47C 5/06 | 297/452.63 |
| 2017/0354259 | A1 * | 12/2017 | Gale | A47C 7/22 | |
| 2020/0237097 | A1 * | 7/2020 | Zheng | A47C 4/02 | |

* cited by examiner

WOVEN STRUCTURE AND CHAIR WITH THE SAME

TECHNICAL FIELD

The utility model relates to a technical field of furniture, in particular to a woven structure and a chair with the same.

BACKGROUND ART

Woven products are light and elegant, with woven strips weaving finely and compactly with each other to present a feeling of simplicity and freshness. However, the woven product include both a woven strip and a support structure. In an existing mechanical production, the woven strip cannot be well arranged on the support structure for different structures. Therefore, existing woven products are generally fabricated manually, which is not only costly to manufacture, but also time consuming and cannot be mass produced.

SUMMARY

In order to overcome at least one disadvantages of the prior art, it is provided in this utility model a woven structure which can be mechanically produced and a chair with the same.

In order to achieve the above purpose, a woven structure which comprises a weaving surface, a skeleton or a wrapping strip is provided in this utility model. The woven surface has an edge and is formed by a staggered arrangement of a plurality of woven strips, wherein one or both ends of several or all the woven strips are provided with a first protrusion, and both ends of each woven strip form edges; the skeleton or the wrapping strip can be disposed and clamped with the first protrusion on the edges of the woven surface.

Optionally, the wrapping strip comprises two pieces of strips, and rims of them are partly connected, with an unconnected part of the rim forming an opening.

Optionally, the skeleton and the wrapping strip are arranged adjacently, and the wrapping strip has two ends each with a second protrusion which can be disposed and clamped on the adjacently arranged skeleton.

Optionally, the skeleton is provided with a groove which is disposed to be fitted with both the first and the second protrusion.

Optionally, widths of both ends of the opening are narrower than that of a middle part of the opening, and the cross section of the first protrusion is any one or more of a T shape, a circle, a triangle, a T-like shape, a circle-like shape and a triangle-like shape, and a shape of the groove is fitted with that of the first protrusion.

Optionally, the shape of the wrapping strip is set according to that of the edge.

A chair with a woven structure is also provided in this utility model which comprises a chair seat and a chair surface. The chair surface comprises a woven structure and is fixed on the chair seat.

Optionally, the woven structure comprises a skeleton and a wrapping strip, wherein the skeleton is arranged at two opposite sides of the edge, and the skeleton and the wrapping strip are arranged adjacently.

Optionally, the chair surface comprises a back surface, a seat surface and a footrest surface, wherein the seat surface is respectively connected with the back surface and the footrest surface; the wrapping strip comprise linear and arc-shaped one, among which the linear one is respectively provided on the back surface and the footrest surface, and the arc-shaped one is provided at a connection of the seat surface with the footrest surface.

Optionally, the skeleton comprises a first skeleton, a second skeleton and a third skeleton, wherein the second skeleton is rotatably connected with the first skeleton and the third skeleton respectively; the first skeleton is provided on two sides of the back surface, the second skeleton is provided on two sides of the seat surface, and the third skeleton is provided on two sides of the footrest surface.

Optionally, the chair with the woven structure further comprises an armrest, wherein an end of the armrest is connected with the first skeleton, and the other end of the armrest is connected with an end of the third skeleton.

Optionally, the chair seat comprises a first support frame and a second support frame, an end of the second support frame is rotatably connected with the armrest, and an end of the first support frame is rotatably connected with the second support frame.

Optionally, a chute is provided on the second skeleton, with which the first support frame is slidably connected.

Optionally, the chair with the woven structure further comprises a supporting strap, wherein the supporting strap is provided on a side of the seat surface, with the two ends being connected with the second skeleton.

To sum up, in the woven structure provided in the utility model, the first protrusion is provided at one or both ends of the woven strip to realize the function of connecting with the skeleton or the wrapping strip. In a chair with the woven structure, the skeleton is an essential part of the chair frame, and the skeleton or the wrapping strip can be clamped and fixed with the first protrusions of the woven strip in sequence by sliding so as to realize the function of connecting the woven strip with the skeleton or the wrapping strip.

DETAILED DESCRIPTION OF PREFERRED EMBODIMENTS

Figure 1:
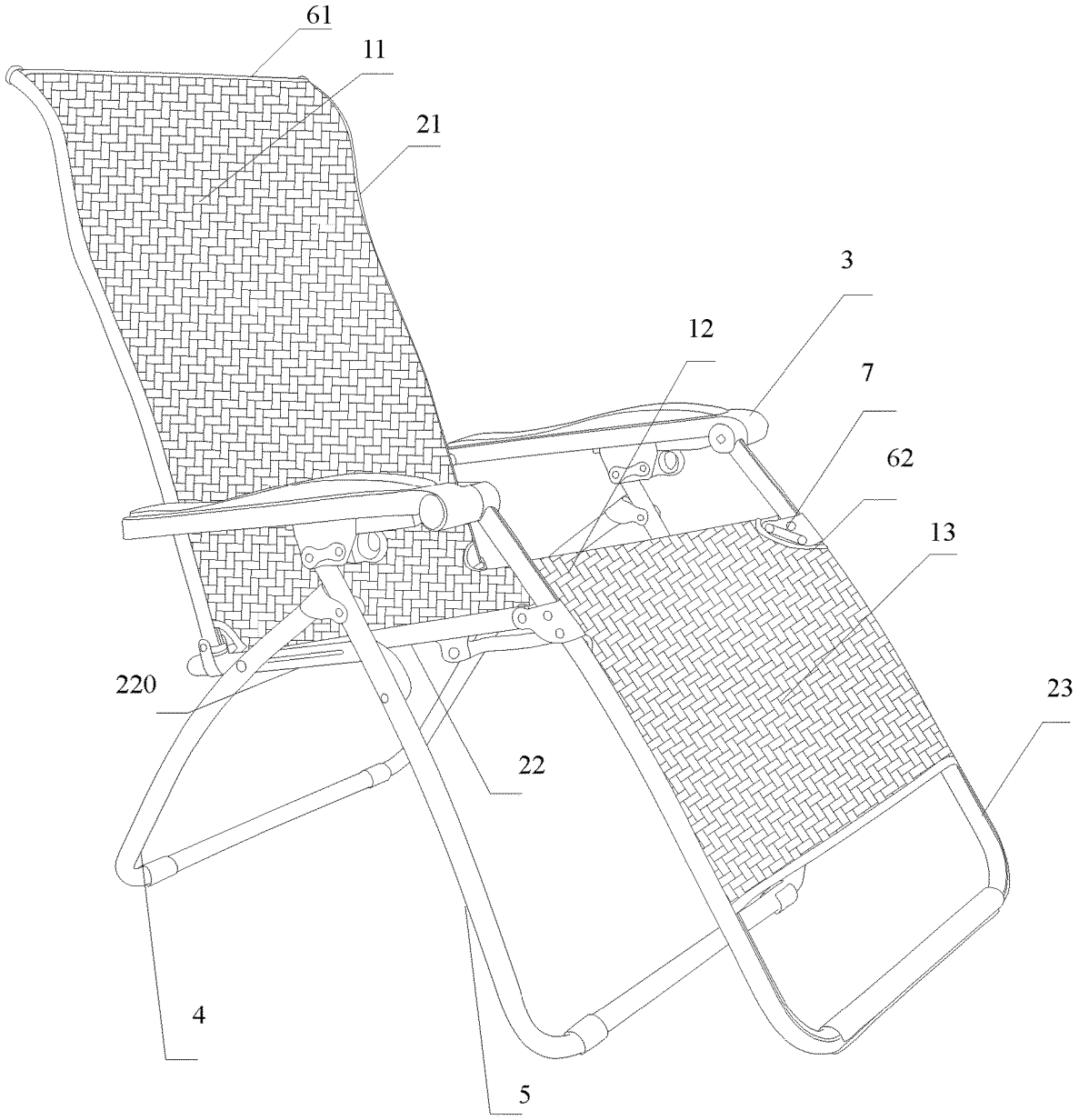
FIG. 1 is a schematic diagram of a chair with a woven structure provided in an embodiment of the utility model.
Figure 2:
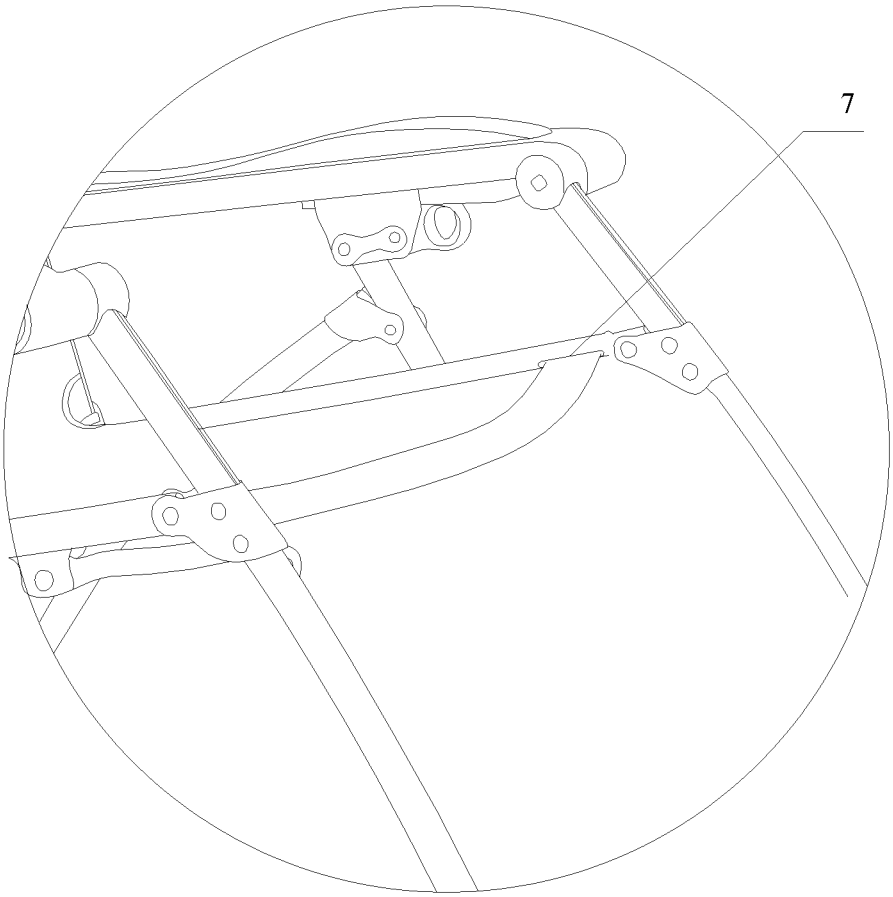
FIG. 2 is one of partial enlarged schematic diagrams of a chair with a woven structure provided in an embodiment of the utility model.
Figure 3:
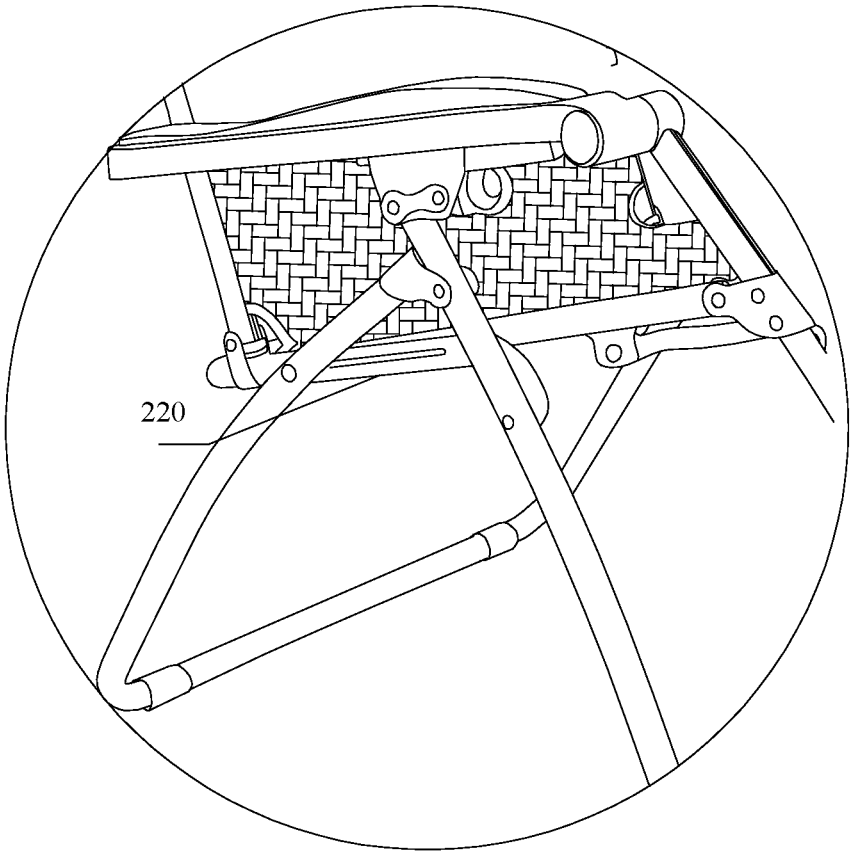
FIG. 3 is another one of partial enlarged schematic diagrams of a chair with a woven structure provided in an embodiment of the utility model.
Figure 4:
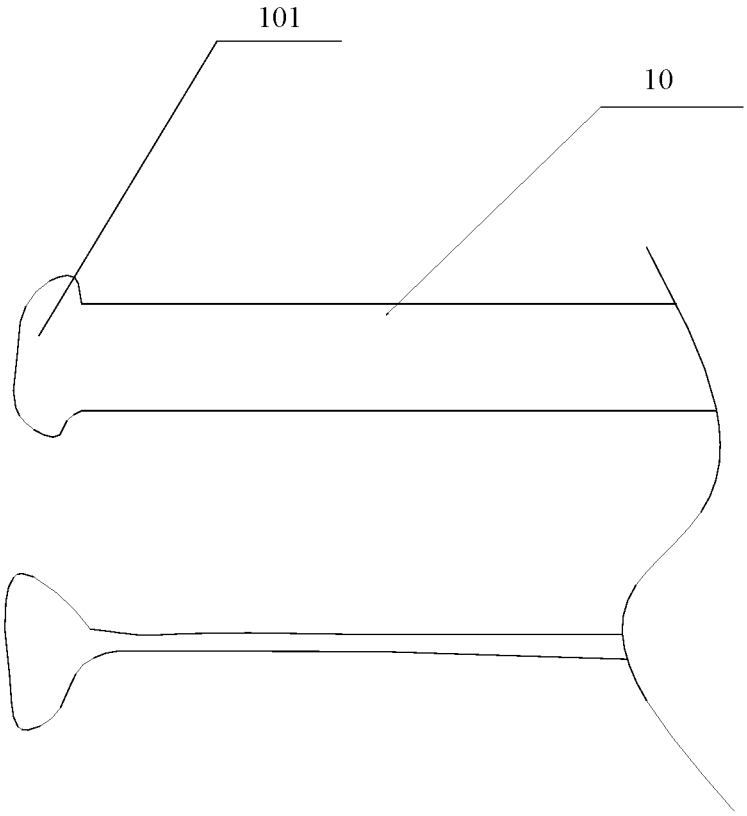
FIG. 4 is a schematic diagram of a woven strip provided in an embodiment of the utility model.

In order to make the above and other objects, features and advantages of the utility model more obvious and understandable, a detailed description is made below for the preferred embodiments with reference to the accompanying drawings.

Please refer to FIGS. 1 to 7. An embodiment of the utility model provides a chair with a woven structure, which comprises a chair seat and a chair surface. The chair surface comprises a woven structure and is fixed on the chair seat. The woven structure comprises a woven surface, a skeleton 2 and wrapping strips. The woven surface has an edge and is formed by a staggered arrangement of a plurality of woven strips 10, both ends of each woven strip 10 are provided with a first protrusion 101 and form edges; and the skeleton 2 and the wrapping strip can be disposed and clamped with the first protrusion 101 on the edges of the woven surface.

The woven structure in this embodiment includes both the skeleton and the wrapping strip, but the "skeleton and wrapping strips" in this utility model also encompasses the case where only the skeleton 2 is included or where only the wrapping strip is included.

In the woven structure provided in this utility model, the first protrusion 101 is provided at both ends of each woven strip 10, respectively and only located at the opposite sides of the edge (i.e. the left and right sides of the edge), and is closely arranged on each side with a more robust fitting with the skeleton. Thus, the function of connecting with the skeleton 2 or the wrapping strip can be realized. In other embodiments, it also can be provided that one end of each unknitted woven strip is provided with the first protrusion 101 with its adjacent woven strips arranged oppositely, so that the first protrusions 101 can be distributed uniformly on the two opposite sides or several sides of the edge, and the first protrusions on each side are regularly arranged at intervals; furthermore, the number of the first protrusions can be decreased to reduce workload. In other embodiments, it also can be provided the case that an end of part of the woven strips is provided with a first protrusion, that part of them is without the first protrusion, and that both ends of the part of them are provided with the first protrusion or any combination of the three cases, in which the woven strips are arranged in parallel with or crossing each other.

In a chair with the woven structure, the skeleton 2 is an essential part of the chair frame, and the skeleton 2 or the wrapping strip can be clamped and fixed with the first protrusions 101 of the woven strip 10 in sequence by sliding so as to realize the function of connecting the woven strip 10 with the skeleton 2 or the wrapping strip. Although the woven structure in the utility model is used in chairs, in other utility models, the woven structure can also be used in any other furniture such as tables, reclining chairs, etc.

The woven strip 10 in the utility model can be made of high-molecular materials, and the first protrusion 101 can be obtained by heat treating one or both ends of the woven strip 10. A shape of the first protrusion 101 in the utility model can be any shape as long as a radial distance of the first protrusion 101 is larger than that of the woven strip 10; preferably, a cross section of the first protrusion 101 can be any one or more of a T shape, a circle, a triangle, a T-like shape, a circle-like shape and a triangle-like shape. The woven structure made of high-molecular materials is unsusceptible to corrosion and resistant to wind and sunlight; in addition, the woven strip 10 can be made of high-molecular materials by an industrial manufacture, which can facilitate to maintain a consistency of the woven strip 10 in size and performance. However, in other embodiments, the woven strip 10 can also be made of canes, bamboos and other materials, and naturally generated lumps of the cane and bamboo can be provided at both ends of the woven strip 10 through a splicing process and can be made use by further modifying their shapes.

In this embodiment, the chair surface comprises a back surface 11, a seat surface 12 and a footrest surface 13, the seat surface 12 is respectively connected with the back surface 11 and the footrest surface 13; the back surface 11 is used for backing a user; the seat surface 12 is used for the user to sit on; and the footrest surface 13 is used for the user to rest foot. The back surface 11, the seat surface 12 and the footrest surface 13 are integrally provided. In other embodiments, the back surface 11, the seat surface 12 and the footrest surface 13 can be separately provided. The wrapping strips comprise linear 61 and arc-shaped 62 ones, among which the linear ones 61 are respectively provided on at the upper end of the back surface 11 and the lower end of the footrest surface 13; the arc-shaped ones 62 are provided at a connection between the seat surface 12 and the footrest surface 13 for wrapping a notch; and the shape of the wrapping strip is set according to that of the edge. In this embodiment, the skeleton 2 is provided on the left and right ends of the back surface 11, the seat surface 12 and the footrest surface 13, and the wrapping strip and the skeleton 2 are arranged adjacently for matching with the first protrusions on the left and right edges so that the skeleton can better match the shape of the first protrusions and provide a support effect.

Although the chair surface in the utility model comprises a back surface 11 and a footrest surface 13, in other embodiments, the chair surface may comprise the seat surface 12 only, or the chair surface may comprise the back surface 11 and the seat surface 12 only, or the chair surface may comprise the seat surface 12 and the footrest surface 13 only.

Figure 5:
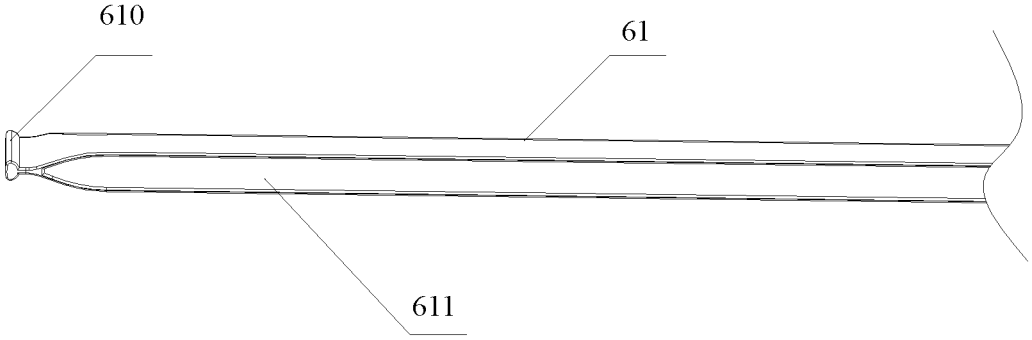
FIG. 5 is a schematic diagram of a linear wrapping strip provided in an embodiment of the utility model.

Still further, as shown in FIG. 5, the linear wrapping strip comprises two rectangular pieces of strips, three ends (rims) of the two pieces of strips are connected and the unconnected end (rim) forms an opening 611 in which the upper side edge and the lower side edge are fixed; during an installation process, the upper side edge and the lower side edge can be fixed in the wrapping strip by sewing the opening after the edges are clamped in the opening. In other embodiments, it is also possible to adhere the edge to the opening. In this embodiment, the upper side edge and the lower side edge is without any first protrusion, and the first protrusions are located at the left and right side edges. In this embodiment, the skeleton 2 and the wrapping strip are arranged adjacently, and the wrapping strip has two ends each with a second protrusion 610 which can be disposed and clamped on the adjacently arranged skeleton 2 to enable the mutually fixing of the skeleton 2 with the adjacently arranged wrapping strip. However, in this embodiment, there are a plurality of wrapping strips which are arranged adjacently, each wrapping strip has two ends, both ends of the wrapping strip are provided with a second protrusions 610 which can be disposed and clamped in the opening of the adjacent wrapping strip, thereby better facilitating the sewing of the adjacent wrapping strip.

Figure 6:
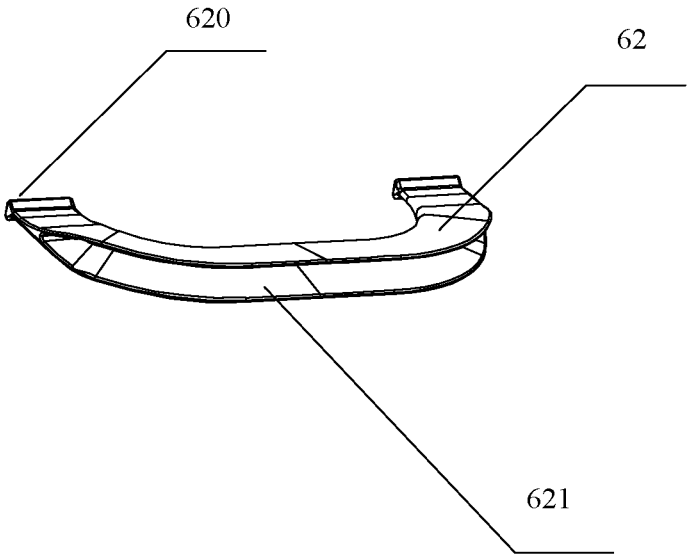
FIG. 6 is a schematic diagram of an arc-shaped wrapping strip provided in an embodiment of the utility model.
Figure 7:
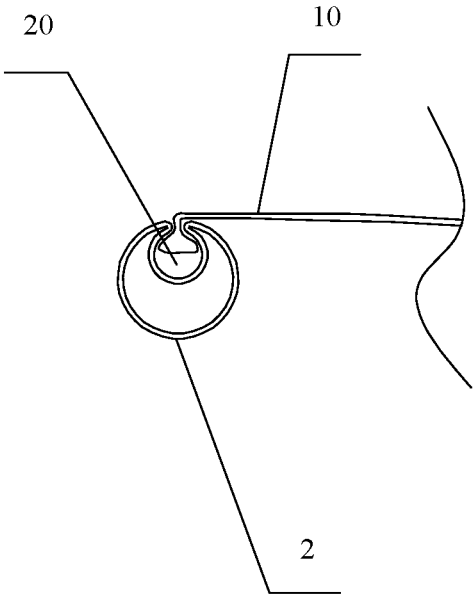
FIG. 7 is a schematic view of the fitted skeleton and woven strip provided in the embodiment of the utility model.

As shown in FIG. 6, the arc-shaped wrapping strip also has an opening 621, and the two ends of the arc-shaped wrapping strip also are provided with a second protrusion 620; the arc-shaped wrapping strip and the linear one function the same and are only different in shape to adapt to different edge structures.

In this embodiment, it is more convenient to wrap the edge of the woven strip with the wrapping strip where there is no first protrusion on the edge (the upper edge and the lower edge), but in other embodiments, the wrapping strip can also be used to wrapping the edge where there is the first protrusion on the edge.

In this embodiment, the skeleton 2 is provided with a groove 20 which is arranged to be fitted with the first protrusion 101 for fixing the woven strip 10 with the skeleton 2, and to be fitted with the second protrusion.

Still further, the skeleton 2 comprises a first skeleton 21, a second skeleton 22 and a third skeleton 23, the second skeleton 22 is rotatably connected with the first skeleton 21 and the third skeleton 23 respectively; the first skeleton 21 is provided on two sides of the back surface 11, the second skeleton 22 is provided on two sides of the seat surface 12, and the third skeleton 23 is provided on two sides of the footrest surface 13. Although the skeleton 2 in this embodiment includes the first skeleton 21, the second skeleton 22 and the third skeleton 23, in other embodiments, the skeleton 2 may be only one, or two, or three, or four, or any number of it.

In this embodiment, the chair with the woven structure further comprises an armrest 3 which is arranged to facilitate the user to rest arms. One end of the armrest 3 is connected to the first skeleton 21, and the other of the armrest 3 is connected to an end of the third skeleton 23. The chair seat comprises a first support frame 4 and a second support frame 5, an end of the second support frame is rotatably connected with the armrest 3, and an end of the first support frame 4 is rotatably connected with the second support frame 5. The first support frame 4 and the second support frame 5 are arranged in a triangle and present a good load-bearing capability. In this embodiment, a chute 220 is provided on the second skeleton 22, with which the first support frame is slidably connected. The chair with the woven structure can be folded by sliding the first support frame 4 on the chute 220.

In this embodiment, the chair with the woven structure further comprises a support strap 7, the support strap 7 is provided on a side of the seat surface 12, with the two ends being connected with the second skeleton 22, in which the connection between the support strap 7 and the second skeleton 22 can be made by a threaded connection such as a screw, and the provision of the support strap 7 increases the strength of the chair surface and ensures that the chair surface is not damaged after being greatly impacted, further ensuring the safety of the user when the chair surface 15 damaged or broken.

In this embodiment, widths of both ends of the opening are narrower than that of a middle part of the opening, and a shape of the groove is provided to be fitted with that of the first protrusion 101. Edge lines at the middle part of the opening are composed of two lines parallel or approximately parallel to each other, and the edge lines at the two ends of the opening are structures in which the these two lines approach to and connect with each other. Both ends are closer to the second protrusion than the middle part.

It should be understood by those skilled in the art that in the disclosure of the utility model, the orientation or positional relationship indicated by the terms "upper", "lower", "front", "rear", "left", "right", "vertical", "horizontal", "top", "bottom", "inner" and "outer" or the like are based on the orientation or positional relationship shown in the drawings, which are only for convenience of describing the utility model and for simplifying the description, but do not indicate or imply that the indicated device or element must have a specific orientation, be constructed and operate in a specific orientation; therefore the above-mentioned terms cannot be understood as limitations to the utility model.

Although the utility model has been disclosed by the preferred embodiment in the above, it is not intended to limit the utility model and any person familiar with the art can make some changes and embellishments without departing from the spirit and scope of the utility model; therefore, the scope of protection of the utility model should be subject to the scope of protection as claimed in the claims.

The invention claimed is:

1. A chair with a woven structure, comprising:

a chair seat frame, a chair surface comprising the woven structure and the chair surface being fixed on the chair seat frame;

wherein the woven structure comprises:

a woven surface having an edge and being formed by a staggered arrangement of a plurality of woven strips, wherein one or both ends of several or all the woven strips are provided with a first protrusion, and both ends of each woven strip form edges;

a skeleton or a wrapping strip, being disposed and clamped with the first protrusion on the edges of the woven surface;

wherein the woven structure comprises the skeleton and the wrapping strip, wherein the skeleton is arranged at two opposite sides of the edge, and the skeleton and the wrapping strip are arranged adjacently;

wherein the chair surface comprises a back surface, a seat surface and a footrest surface, wherein the seat surface is respectively connected with the back surface and the footrest surface; the wrapping strip comprises linear and arc-shaped one, among which the linear one is respectively provided on the back surface and the footrest surface, and the arc-shaped one is provided at a connection of the seat surface with the footrest surface.

2. The chair with the woven structure according to claim 1, wherein the skeleton comprises a first skeleton, a second skeleton and a third skeleton, wherein the second skeleton is rotatably connected with the first skeleton and the third skeleton respectively; the first skeleton is provided on two sides of the back surface, the second skeleton is provided on two sides of the seat surface, and the third skeleton is provided on two sides of the footrest surface.

3. The chair with the woven structure according to claim 2, wherein the chair with the woven structure further comprises an armrest, wherein an end of the armrest is connected with the first skeleton, and the other end of the armrest is connected with an end of the third skeleton.

4. The chair the with woven structure according to claim 3, wherein the chair seat frame comprises a first support frame and a second support frame, wherein an end of the second support frame is rotatably connected with the armrest, and an end of the first support frame is rotatably connected with the second support frame.

5. The chair with the woven structure according to claim 4, wherein a chute is provided on the second skeleton, with which the first support frame is slidably connected.

6. The chair with the woven structure according to claim 2, wherein the chair with the woven structure further comprises a supporting strap, wherein the supporting strap is provided on a side of the seat surface, with the two ends being connected with the second skeleton.

7. The chair with the woven structure according to claim 1, wherein the wrapping strip comprises two pieces of strips, and rims of them are partly connected, with an unconnected part of the rim forming an opening.

8. The chair with the woven structure according to claim 7, wherein the skeleton and the wrapping strip are arranged adjacently, and the wrapping strip has two ends each with a second protrusion which can be disposed and clamped on the adjacently arranged skeleton.

9. The chair with the woven structure according to claim 8, wherein the skeleton is provided with a groove which is disposed to be fitted with both the first and the second protrusion.

10. The chair with the woven structure according to claim 9, wherein the width of both ends of the opening is narrower than the width of a middle part of the opening, the cross section of the first protrusion is any one or more of a T shape, a circle, a triangle, a T-like shape, a circle-like shape and a triangle-like shape, and a shape of the groove is fitted with the shape of the first protrusion.

11. The chair with the woven structure according to claim 1, wherein the shape of the wrapping strip is set according to the shape of the edge.

* * * * *